US010125997B2

(12) United States Patent
Park et al.

(10) Patent No.: US 10,125,997 B2
(45) Date of Patent: Nov. 13, 2018

(54) BURNER

(71) Applicant: LG ELECTRONICS INC., Seoul (KR)

(72) Inventors: Janghee Park, Seoul (KR); Yongki Jeong, Seoul (KR); Jaebeom Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 506 days.

(21) Appl. No.: 14/864,255

(22) Filed: Sep. 24, 2015

(65) Prior Publication Data

US 2016/0178209 A1 Jun. 23, 2016

(30) Foreign Application Priority Data

Dec. 17, 2014 (KR) ..... 10-2014-0182329

(51) Int. Cl.
*F24C 3/08* (2006.01)
*F23D 14/84* (2006.01)

(52) U.S. Cl.
CPC ..... *F24C 3/08* (2013.01); *F23D 14/84* (2013.01); *F23D 2203/1026* (2013.01); *F23D 2900/14062* (2013.01)

(58) Field of Classification Search
CPC ... F23D 14/84; F23D 2900/14062; F24C 3/08
USPC ..... 126/39 E, 39 R
See application file for complete search history.

(56) References Cited

U.S. PATENT DOCUMENTS 5,842,849 A * 12/1998 Huang ..... F23D 14/06 126/39 R
2003/0101980 A1* 6/2003 Brown ..... F23D 14/06 126/39 R
2010/0206293 A1* 8/2010 Padgett ..... F23D 14/06 126/39 E

* cited by examiner

*Primary Examiner* — Avinash Savani
*Assistant Examiner* — Aaron Heyamoto
(74) *Attorney, Agent, or Firm* — Dentons US LLP

(57) ABSTRACT

Provided is a burner including a burner head to receive a mixed gas; and a burner cap to cover the burner head, wherein the burner head includes an outer wall having a plurality of first flame holes at which a flame is generated, an inner wall located at an inside of the outer wall and having a plurality of second flame holes at which a flame is generated, and a mixed gas chamber defined between the outer wall and the inner wall, and the burner cap includes a distribution guide to guide a flow of the mixed gas so that the mixed gas introduced into the mixed gas chamber is evenly distributed in the mixed gas chamber.

18 Claims, 5 Drawing Sheets

BURNER

CROSS-REFERENCE TO RELATED APPLICATION(S)

This application claims priority under 35 U.S.C. § 119 to Korean Application No. 10-2014-0182329, filed in Korea on Dec. 17, 2014, whose entire disclosure is hereby incorporated by reference.

BACKGROUND

1. Field

A burner is disclosed herein.

2. Background

Generally, a burner serves to directly heat food or a container filled with the food using a flame generated when burning a gas.

Efficiency or heating performance of the burner may be enhanced when the flame is uniformly generated from the burner.

Korean Unexamined Patent Application Publication No. 2014-0090773 (published on Jul. 18, 2014) discloses a burner cap and a burner.

In the above-described related document, a distribution protrusion is formed on a lower surface of the burner cap, and a connection guide protrudes from an edge of the distribution protrusion. A mixed gas runs into the distribution protrusion, and a flow speed thereof is primarily reduced, and then secondarily reduced by a distribution guide, and thus the mixed gas is spread in an area formed by the connection guide.

However, in the case of the related document, since the distribution protrusion is provided at only a position corresponding to a mixer tube, and the connection guide protrudes downward from the distribution protrusion, there is a problem in that the mixed gas flowing over the connection guide flows to only flame holes near the connection guide, and is not evenly distributed toward flame holes far from the connection guide. That is, since the connection guide does not serve to guide the mixed gas toward the flame holes far from the connection guide, an intensity of the flame of the flame holes near the connection guide is relatively large.

SUMMARY

The present disclosure is directed to a burner in which a mixed gas is evenly distributed, and thus a flame is uniformly generated.

According to an aspect of the present disclosure, there is provided a burner including a burner head configured to receive a mixed gas; and a burner cap configured to cover the burner head, wherein the burner head comprises an outer wall having a plurality of first flame holes at which a flame is generated, an inner wall located at an inside of the outer wall and having a plurality of second flame holes at which a flame is generated, and a mixed gas chamber defined between the outer wall and the inner wall, the burner cap comprises a distribution guide configured to guide a flow of the mixed gas so that the mixed gas introduced into the mixed gas chamber is evenly distributed in the mixed gas chamber, the mixed gas introduced into the mixed gas chamber is able to flow along the distribution guide in a circumferential direction, and a portion of the mixed gas flowing in the circumferential direction is distributed to the plurality of first flame holes of the outer wall, and another portion of the mixed gas flowing in the circumferential direction flows over the distribution guide and then flows toward the plurality of second flame holes of the inner wall.

According to another aspect of the present disclosure, there is provided a burner including a burner head configured to receive a mixed gas; and a burner cap configured to cover the burner head, wherein the burner head comprises an outer wall having a plurality of first flame holes at which a flame is generated, an inner wall located at an inside of the outer wall and having a plurality of second flame holes at which a flame is generated, and a mixed gas chamber defined between the outer wall and the inner wall, the burner cap comprises a distribution guide configured to guide a flow of the mixed gas so that the mixed gas introduced into the mixed gas chamber is evenly distributed in the mixed gas chamber, the mixed gas introduced into the mixed gas chamber is able to flow along the distribution guide in a circumferential direction, and a lower surface of the distribution guide is located lower than a lowest point of the second flames hole based on a bottom wall of the mixed gas chamber.

The details of one or more embodiments are set forth in the accompanying drawings and the description below. Other features will be apparent from the description and drawings, and from the claims.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
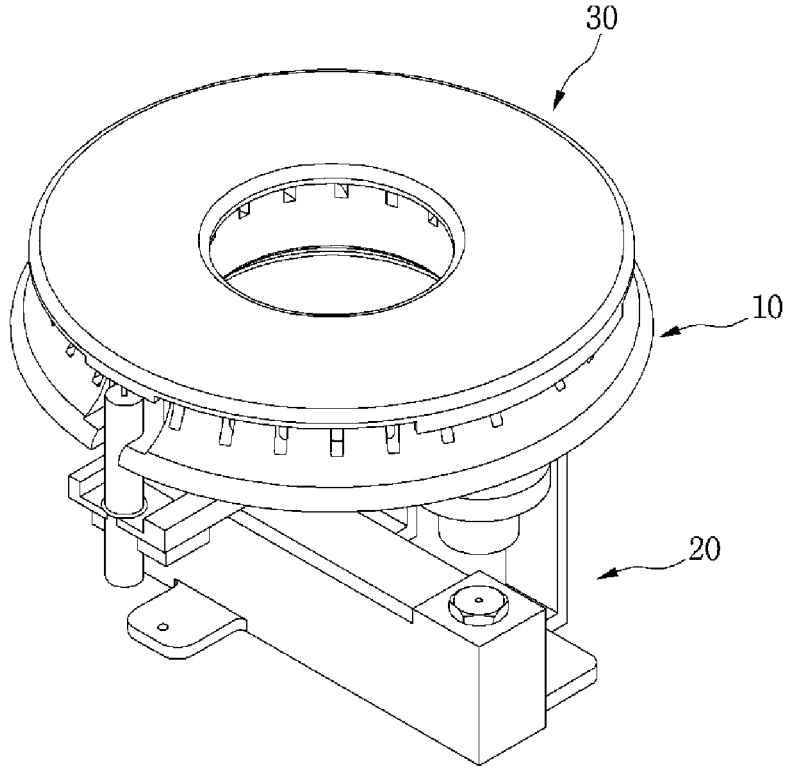
FIG. 1 is a perspective view of a burner according to an embodiment.
Figure 2:
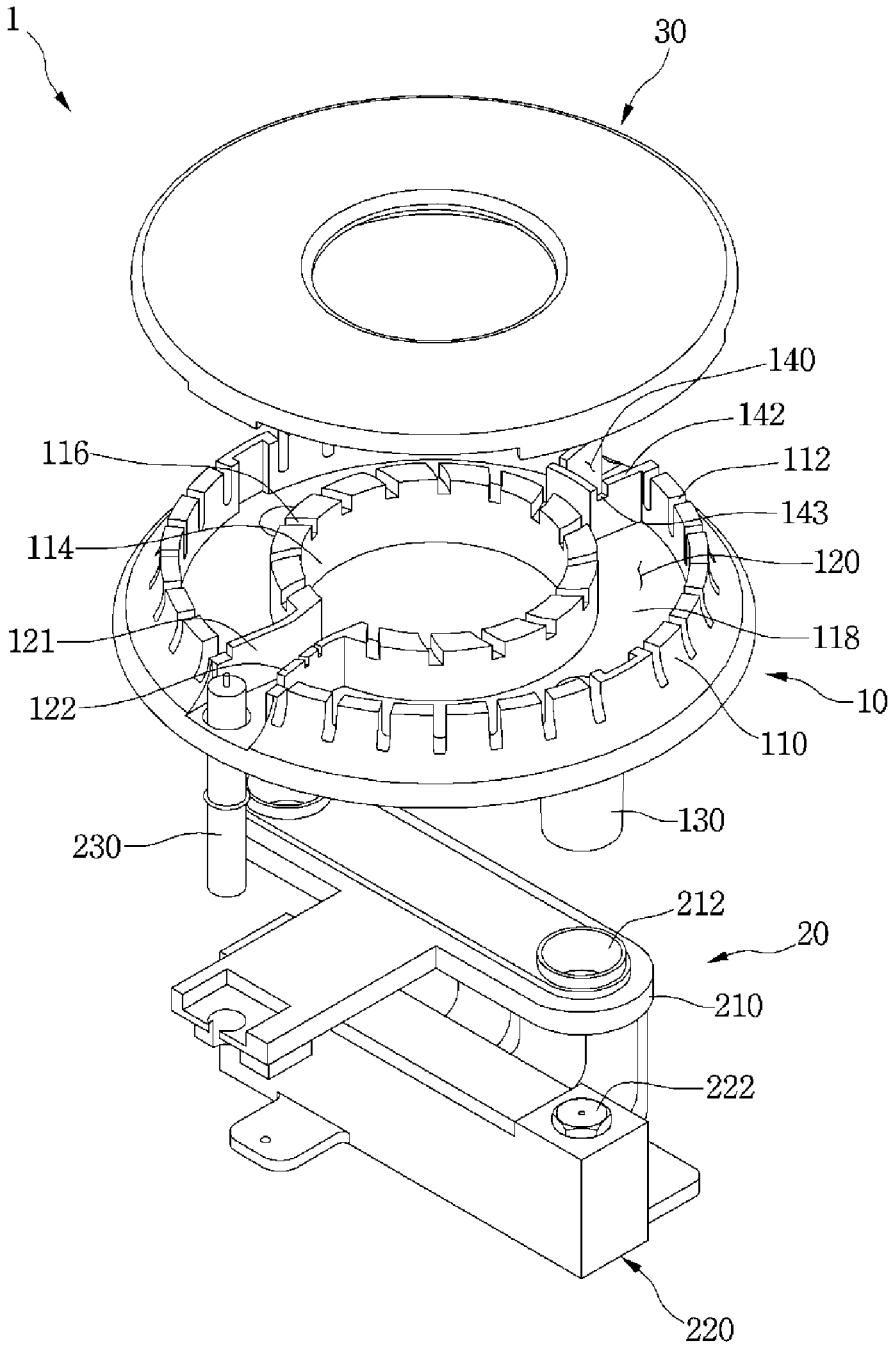
FIG. 2 is an exploded perspective view of the burner of FIG. 1.

FIG. 1 is a perspective view of a burner according to an embodiment, and FIG. 2 is an exploded perspective view of the burner of FIG. 1.

Referring to FIGS. 1 and 2, the burner 1 according to the embodiment may include a burner head 10 having a plurality of flame holes through which a flame is discharged, a burner body 20 which supports the burner head 10, and a burner cap 30 which is seated on an upper side of the burner head 10.

The burner 1 may further include an ignition part 230 which ignites a mixed gas of air and a gas supplied to the burner head 10.

The burner body 20 may include a head support part 210 which supports the burner head 10, and a gas supply part 220 which is connected with the head support part 210.

The head support part 210 may include an opening 212 through which mixed gas supply pipes 130 and 131 (referring to FIG. 4) of the burner head 10 may pass.

The gas supply part 220 may receive the gas and may supply the gas to the burner head 10. The gas supply part 220 may have a plurality of nozzles 222.

Also, the gas supply part 220 may support the ignition part 230.

The burner head 10 may include an outer wall 110 (which may be referred to as a "first wall"), and an inner wall 114 (which may be referred to as a "second wall") which is spaced from the outer wall 110 toward an inside of the outer wall 110.

The outer wall 110 may include a plurality of first flame holes 112 through which the flame is discharged. The plurality of first flame holes 112 may be disposed to be spaced in a circumferential direction of the outer wall 110.

The inner wall 114 may include a plurality of second flame holes 116 through which the flame is discharged. The plurality of second flame holes 116 may be disposed to be spaced in a circumferential direction of the inner wall 114.

The burner head 10 may further include a bottom wall 118 which forms a mixed gas chamber 120 together with the outer wall 110 and the inner wall 114.

The burner cap 30 may be seated on the outer wall 110 and the inner wall 114. And the burner cap 30 may cover the mixed gas chamber 120.

One or more mixed gas supply pipes 130 and 131 (referring to FIG. 4) through which the mixed gas is supplied may be connected to the bottom wall 118. The mixed gas supply pipes 130 and 131 (referring to FIG. 4) may be integrally formed with the bottom wall 118, or may be separately formed from the bottom wall 118 and then may be coupled to the bottom wall 118.

The mixed gas supply pipes 130 and 131 (referring to FIG. 4) may pass through the opening 212 formed at the head support part 210 of the burner body 20. While the burner head 10 is seated on the head support part 210 of the burner body 20, the mixed gas supply pipes 130 and 131 (referring to FIG. 4) are spaced from the nozzles 222 provided at the gas supply part 220.

Therefore, when the gas is sprayed from the nozzles 222, air around the mixed gas supply pipes 130 and 131 (referring to FIG. 4) is introduced into the mixed gas supply pipes 130 and 131 together with the gas.

The outer wall 110 and the inner wall 114 may be connected by a plurality of connection walls 121 and 122.

Each of the outer wall 110 and the inner wall 114 may be formed to have an approximately "C" shape when seen from an upper side, and an end of the inner wall 114 and an end of the outer wall 110 may be connected by the plurality of connection walls 121 and 122.

The plurality of connection walls 121 and 122 may include a first connection wall 121 and a second connection wall 122 which is spaced from the first connection wall 121.

The first connection wall 121 may connect one end of the outer wall 110 with one end of the inner wall 114. The second connection wall 122 may connect the other end of the outer wall 110 with the other end of the inner wall 114. Therefore, the mixed gas chamber 120 may also be formed to have an approximately "C" shape when seen from an upper side.

At least a part of the ignition part 230 may be located between the first connection wall 121 and the second connection wall 122.

A space between the first connection wall 121 and the second connection wall 122 may serve as a flame spread passage through which the flame is spread between the outer wall 110 and the inner wall 114.

The burner head 10 may further include a flame staying chamber 140 which provides a space allowing the flame to be stayed therein.

The flame staying chamber 140 may be formed by recessing a part 142 (hereinafter referred to as a "chamber forming wall") of the outer wall 110 toward the inner wall 114. One or more slits 143 may be formed at the chamber forming wall 142.

According to the flame staying chamber 140, the flame may be stayed in the flame staying chamber 140, even though the flame of the outer wall 110 and the inner wall 114 is extinguished in the process of using the burner 1, and thus the mixed gas may be reignited at the outer wall 110 and the inner wall 114 by the flame in the flame staying chamber 140, thereby generating the flame.

In particular, when the burner 1 is used while being installed at a gas oven range, or the gas oven range is used in a built-in state, the flame of the inner wall 114 and the outer wall 110 of the burner 1 may be extinguished in the process of opening and closing an oven door of the gas oven range. Even in this case, the mixed gas may be reignited at the outer wall 110 and the inner wall 114 by the flame in the flame staying chamber 140, and thus the flame may be generated.

Figure 3:
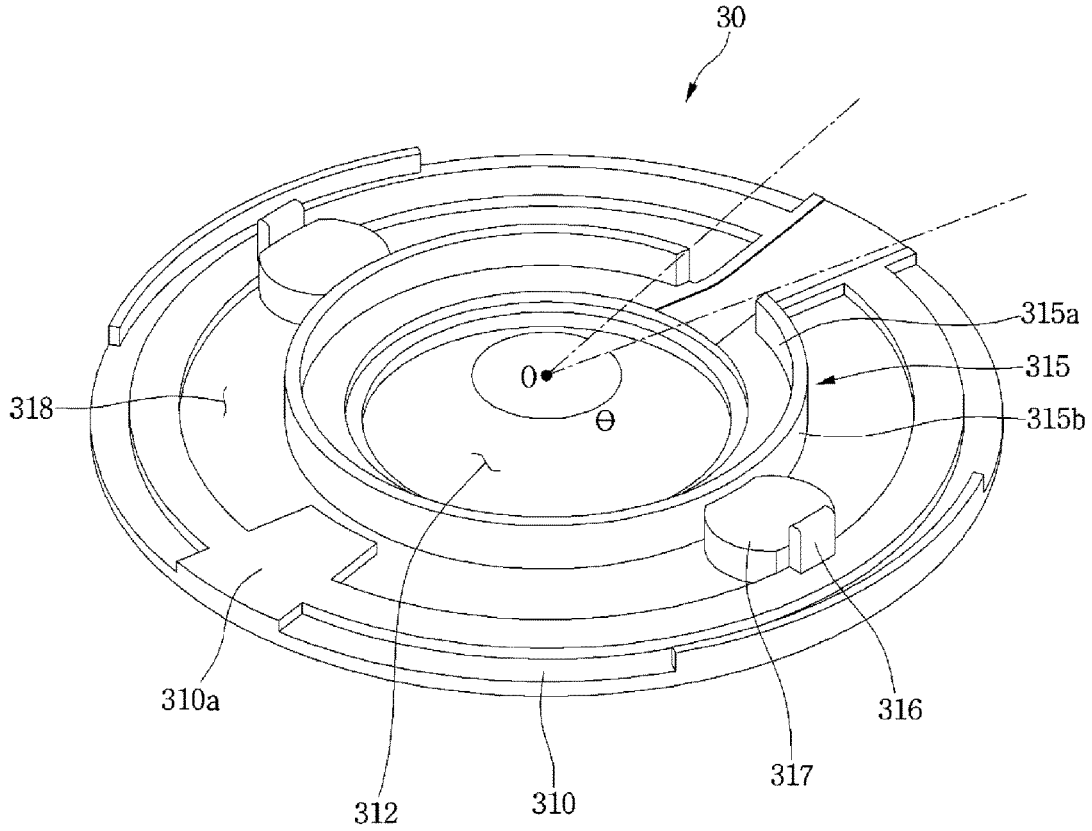
FIG. 3 is a perspective view of a burner cap according to the embodiment.
Figure 4:
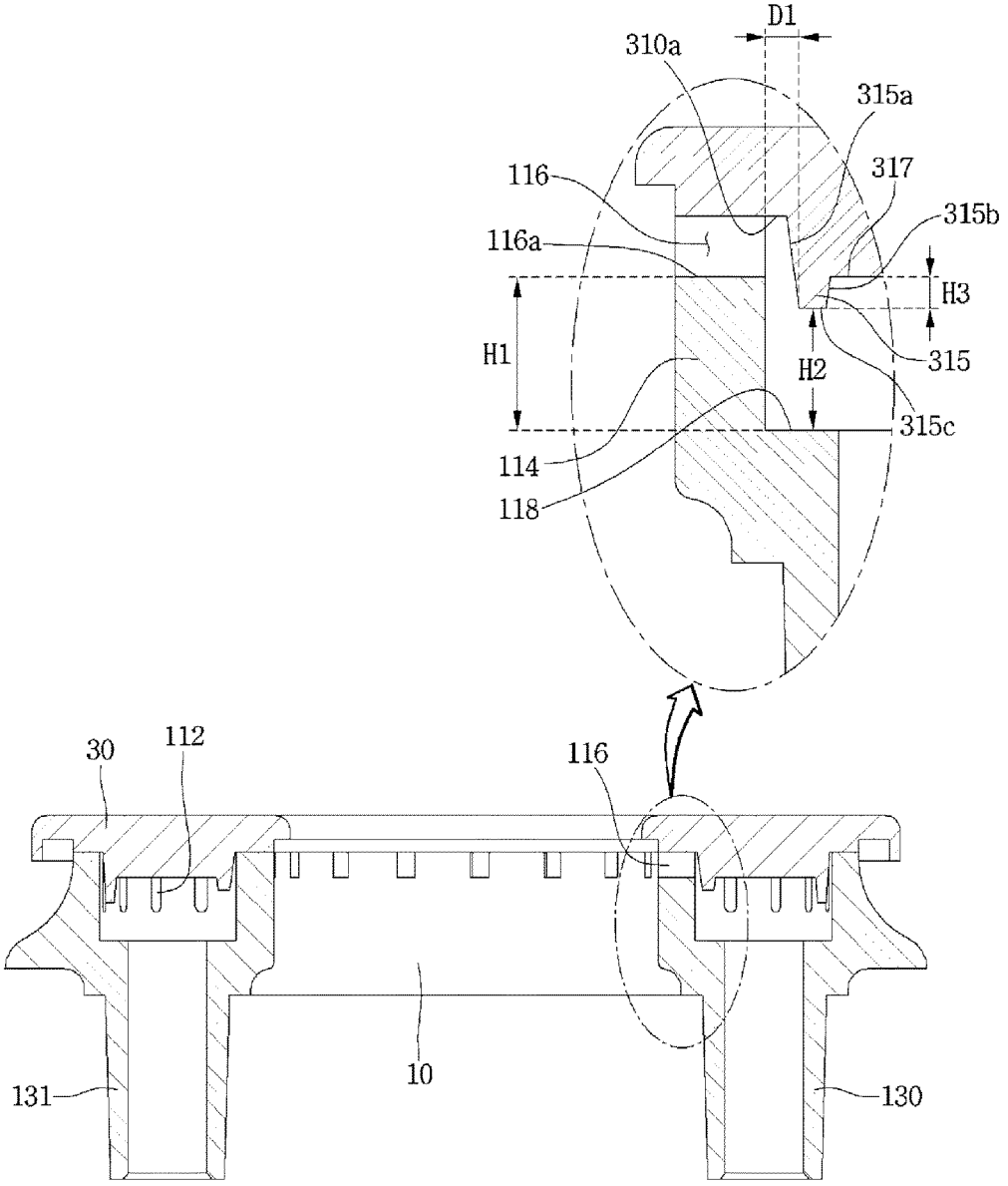
FIG. 4 is a cross-sectional view of the burner according to the embodiment.

FIG. 3 is a perspective view of the burner cap 30 according to the embodiment, and FIG. 4 is a cross-sectional view of the burner 1 according to the embodiment.

In FIG. 3, a lower structure of the burner cap is illustrated as an example.

Referring to FIGS. 2 to 4, the burner cap according to the embodiment may include a cap body 310 having an opening 312 formed at a center portion thereof. The flame generated in the second flame holes 116 of the inner wall 114 may pass through the opening 312.

The burner cap 30 may further include a distribution guide 315 which protrudes downward from a lower surface 310*a* of the cap body 310 so that the mixed gas introduced into the mixed gas chamber 120 within the burner head 10 is evenly distributed into the mixed gas chamber 120.

The distribution guide 315 may be rounded in a horizontal direction, and both ends thereof may be spaced in the horizontal direction. For example, the distribution guide 315 may have an approximately "C" shape when seen from an upper side. A circumferential length of the distribution guide 315 is longer than a horizontal distance between the spaced both ends.

While the burner cap 30 is seated on the burner head 10, the distribution guide 315 may be accommodated in the mixed gas chamber 120.

The both ends of the distribution guide 315 are spaced from each other to prevent interference with the first and second connection walls 121 and 122 while the burner cap 30 is seated on the burner head 10.

The distribution guide 315 may be spaced from the outer wall 110 and the inner wall 114.

Also, a part of the distribution guide 315 may be located between the chamber forming wall 142 and the inner wall 114. A maximum thickness of the distribution guide 315 is smaller than a distance between the chamber forming wall 142 and the inner wall 114.

The distribution guide 315 may be spaced from the chamber forming wall 142 so that the mixed gas passes through between the distribution guide 315 and the chamber forming wall 142.

The distribution guide 315 may include a guide lower surface 315*c* which has a predetermined width, and an inner circumferential surface 315*a* and an outer circumferential surface 315*b* which connect the guide lower surface 315*c* with the lower surface 310*a* of the cap body 310.

The inner circumferential surface 315*a* is disposed closer to the inner wall 114 than the outer wall 110. The inner circumferential surface 315*a* is a surface facing the inner wall 114.

The outer circumferential surface 315*b* is disposed closer to the outer wall 110 than the inner wall 114. The outer circumferential surface 315*b* is a surface facing the outer wall 110.

The outer circumferential surface 315*b* of the distribution guide 315 serves to guide the mixed gas introduced into the mixed gas chamber 120 to flow along the outer circumferential surface 315*b* and then to be evenly distributed in the mixed gas chamber 120. A portion of the mixed gas flowing along the outer circumferential surface 315*b* may flow over the distribution guide 315 and then may be distributed to the plurality of second flame holes 116 of the inner wall 114.

The guide lower surface 315*c* of the distribution guide 315 may be spaced from the bottom wall 118 of the mixed gas chamber 120.

In order to prevent the mixed gas introduced into the mixed gas chamber 120 from flowing concentrically to some of the plurality of second flame holes 116 adjacent to the mixed gas supply pipes 130 and 131, a height H2 of the guide lower surface 315*c* of the distribution guide 315 from the bottom wall 118 of the mixed gas chamber 120 may be lower than a height H1 of a lowest point 116*a* of the second flame holes 116 of the inner wall 114 from the bottom wall 118 of the mixed gas chamber 120.

That is, the guide lower surface 315*c* of the distribution guide 315 may be located lower than the lowest point 116*a* of the second flame hole 116 of the inner wall 114.

A difference H1−H2 between the height H1 of a lowest point 116*a* of the second flame holes 116 of the inner wall 114 from the bottom wall 118 of the mixed gas chamber 120 and the height H2 of the guide lower surface 315*c* of the distribution guide 315 from the bottom wall 118 of the mixed gas chamber 120 may be 2 mm or more.

Also, a horizontal separation distance D1 between the guide lower surface 315*c* of the distribution guide 315 and the inner wall 114 may be 1 mm or more.

When the horizontal separation distance D1 between the guide lower surface 315*c* of the distribution guide 315 and the inner wall 114 is less than 1 mm, an amount of the mixed gas flowing to the second flame holes 116 may be substantially too small, and thus an intensity of the flame of the second flame holes 116 may be small, or the flame may not be generated.

The horizontal separation distance D1 between the guide lower surface 315*c* of the distribution guide 315 and the inner wall 114 may be 5 mm or less. When the horizontal separation distance D1 between the guide lower surface 315*c* of the distribution guide 315 and the inner wall 114 is more than 5 mm, the guide lower surface 315*c* of the distribution guide 315 may be longitudinally overlapped with the mixed gas supply pipes 130 and 131.

Therefore, a portion of the mixed gas may not flow along the outer circumferential surface 315*b* of the distribution guide 315, but may flow over the distribution guide 315, and may flow to the second flame holes 116 located adjacent to the mixed gas supply pipes 130 and 131, and thus it is not preferable. That is, the guide lower surface 315*c* of the distribution guide 315 may be disposed not to be longitudinally overlapped with the mixed gas supply pipes 130 and 131.

The burner cap 30 may further include a distribution protrusion 317 which protrudes downward from the lower surface 310*a* of the cap body 310. The distribution protrusion 317 may be disposed to face the mixed gas supply pipes 130 and 131. The distribution protrusion 317 may be formed in a cylindrical shape or a cylinder-like shape. The distribution protrusion 317 may be located between the outer circumferential surface 315*b* of the distribution guide 315 and the outer wall 110.

The number of distribution protrusions 317 may be the same as that of the mixed gas supply pipes 130 and 131. The distribution protrusion 317 serves to reduce a flow speed of the mixed gas introduced through the mixed gas supply pipes 130 and 131 and flowing upward.

And the distribution protrusion 317 may be in contact with a part of the outer circumferential surface 315*b* of the distribution guide 315. The distribution protrusion 317 may be integrally formed with or separately formed from the distribution guide 315.

At this time, a protruding height of the distribution guide 315 from the lower surface 310*a* of the cap body 310 is higher than that of the distribution protrusion 317. That is, a height of the lower surface 310*a* of the distribution guide from the bottom wall 118 is lower than that of a lower surface of the distribution protrusion 317 from the bottom wall 118.

A difference between the protruding heights of the distribution guide 315 and the distribution protrusion may be 3 mm or more. Therefore, an amount of the mixed gas which collides with the distribution protrusion 317 and then flows over the distribution guide 315 may be minimized.

The lower surface 310*a* of the cap body 310 may further include a recessed portion 318 which guides a flow of the mixed gas so that the mixed gas smoothly flows along the outer circumferential surface 315*b* of the distribution guide 315 in the circumferential direction. The recessed portion 318 may be recessed upward from the lower surface 310*a* of the cap body 310.

The outer circumferential surface 315*b* of the distribution guide 315 may be disposed to be inclined at a predetermined angle with respect to a vertical line so that the mixed gas flowing along the outer circumferential surface 315*b* of the distribution guide 315 in the circumferential direction easily flows over the distribution guide 315.

The inner circumferential surface 315*a* of the distribution guide 315 may be disposed to be inclined at a predetermined angle with respect to the vertical line so that the mixed gas flowing over the distribution guide 315 easily flows toward the second flame holes 116 of the inner wall 114.

In order to enhance uniform distribution performance of the mixed gas in the mixed gas chamber 120 by the distribution guide 315, an angle θ formed between the both ends of the distribution guide 315 centering on a center o of the burner cap 30 may be 330 degrees or more.

The burner cap 30 may further include a flow resistance portion 316 which protrudes downward from the lower surface 310*a* of a cap body 310.

The flow resistance portion 316 prevents the mixed gas colliding with the distribution protrusion 317 from being concentrated on some of the plurality of first flame holes 112 located adjacent to the distribution protrusion 317.

Hereinafter, a distributing process of the mixed gas by the distribution guide 315 will be described.

While the mixed gas introduced into the mixed gas chamber 120 through the plurality of mixed gas supply pipes 130 and 131 collides with the distribution protrusion 317, the flow speed thereof is reduced.

The mixed gas colliding with the distribution protrusion 317 may have two flow patterns.

In a first flow pattern, the mixed gas collides with the distribution protrusion 317, flows over the distribution guide 315 and the flow resistance portion 316, and then flows along the lower surface 310*a* of the cap body 310 toward the outer wall 110 and the inner wall 114 adjacent to the distribution protrusion 317.

In a second flow pattern, the mixed gas collides with the distribution protrusion 317, and then flows along the outer circumferential surface 315*b* of the distribution guide 315 in the circumferential direction.

A flow resistance of the mixed gas in the second flow pattern of the two flow patterns is smaller than a flow resistance of the mixed gas in the first flow pattern. Therefore, most of the mixed gas flows along the outer circumferential surface 315*b* of the distribution guide 315 in the circumferential direction after colliding with the distribution protrusion 317, as described in the second flow pattern. Of course, a small amount of the mixed gas may flow over the distribution guide 315 and the flow resistance portion 316 after colliding with the distribution protrusion 317, and then may flow along the lower surface 310*a* of the cap body 310 toward the outer wall 110 and the inner wall 114.

And a portion of the mixed gas flowing in the circumferential direction may be distributed to the plurality of first flame holes 112.

Another portion of the mixed gas flowing in the circumferential direction may flow over the distribution guide 315 and then may be distributed to the plurality of second flame holes 116.

Figure 5:
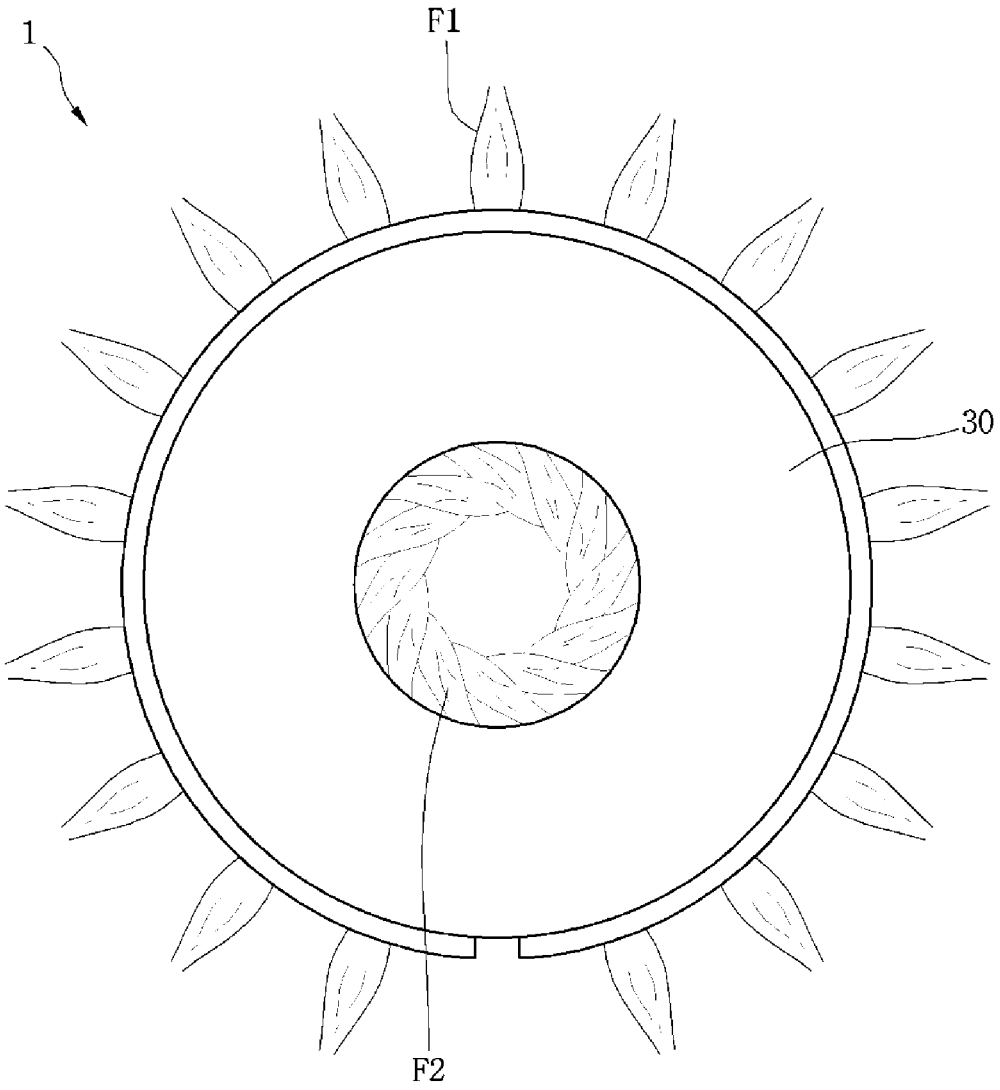
FIG. 5 is a view illustrating a flame generated by the burner according to the embodiment.

FIG. 5 is a view illustrating the flame generated from the burner 1 according to the embodiment.

Referring to FIG. 5, as the mixed gas introduced into the mixed gas chamber 120 flows along the outer circumferential surface 315*b* of the distribution guide 315 in the circumferential direction, the mixed gas may be evenly distributed into the mixed gas chamber 120, and thus the flame F1 generated at the first flame holes 112 of the outer wall 110 may be generally uniform, and also the flame F2 generated at the second flame holes 116 of the inner wall 114 may be generally uniform.

At this time, each of the plurality of second flame holes 116 may be disposed so that the flame F2 generated in each of the plurality of the second flame holes 116 is generated in a direction which is inclined with respect to a line perpendicular to the inner wall 114, instead of a direction which is in parallel therewith.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or comprises or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A burner comprising:

a burner head to receive a mixed gas; and a burner cap to cover the burner head, wherein the burner head comprises an outer wall having a plurality of first flame holes at which a flame is generated, an inner wall having a plurality of second flame holes at which a flame is generated, a mixed gas chamber provided between the outer wall and the inner wall, and a mixed gas supply pipe to supply the mixed gas to the mixed gas chamber, wherein the inner wall is provided at an inside area of the outer wall, wherein the burner cap comprises a distribution guide protruded from a lower surface of the burner cap to guide a flow of the mixed gas so that the mixed gas introduced into the mixed gas chamber is substantially evenly distributed in the mixed gas chamber and a distribution protrusion that faces the mixed gas supply pipe and protrudes from the lower surface of the burner cap, wherein a protruding height of the distribution guide from the lower surface of the burner cap is higher than the protruding height of the distribution protrusion from the lower surface of the burner cap, whereby the mixed gas introduced into the mixed gas chamber flows along the distribution guide in a circumferential direction, and a portion of the mixed gas flowing in the circumferential direction is distributed to the plurality of first flame holes of the outer wall, and another portion of the mixed gas flowing in the circumferential direction flows over the distribution guide and toward the plurality of second flame holes of the inner wall.

2. The burner of claim 1, wherein the distribution guide protrudes downward from a lower surface of the burner cap, and wherein the distribution guide has a shape that is rounded in a horizontal direction and comprises a first end and a second end that are spaced apart from each other.

3. The burner of claim 1, wherein a lower surface of the distribution guide is spaced from a bottom wall to form the mixed gas chamber, the lower surface being located at a lower position than a lowest point of the second flame holes.

4. The burner of claim 1, wherein the distribution guide protrudes downward from a lower surface of the burner cap, the distribution guide being located between the inner wall and the outer wall and spaced apart from the inner wall and the outer wall.

5. The burner of claim 4, wherein the distribution guide is located closer to the inner wall than to the outer wall.

6. The burner of claim 5, wherein the distribution guide comprises:

a guide lower surface;

an inner circumferential surface; and an outer circumferential surface, wherein the inner and outer circumferential surfaces connect the guide lower surface with the lower surface of the burner cap, and wherein the mixed gas introduced into the mixed gas chamber flows along the outer circumferential surface of the distribution guide in the circumferential direction.

7. The burner of claim 6, wherein the outer circumferential surface of the distribution guide is inclined at a predetermined angle with respect to a vertical line so that the mixed gas flowing along the outer circumferential surface flows over the distribution guide toward the inner circumferential surface thereof.

8. The burner of claim 6, wherein the inner circumferential surface of the distribution guide is inclined at a predetermined angle with respect to a vertical line so that the mixed gas flowing over the distribution guide flows toward the second flame holes.

9. The burner of claim 1, wherein the distribution protrusion is provided between the distribution guide and the outer wall.

10. The burner of claim 1, wherein the burner cap further comprises a flow resistance portion to prevent the mixed gas supplied from the mixed gas supply pipe from being concentrated on the plurality of first flame holes provided adjacent to the mixed gas supply pipe.

11. The burner of claim 1, wherein the burner cap further comprises a recessed portion to guide a flow of the mixed gas when the mixed gas flows along the distribution guide in the circumferential direction.

12. A burner comprising:

a burner head to receive a mixed gas; and a burner cap to cover the burner head, wherein the burner head comprises an outer wall having a plurality of first flame holes at which a flame is generated, an inner wall having a plurality of second flame holes at which a flame is generated, a mixed gas chamber provided between the outer wall and the inner wall, and a mixed gas supply pipe to supply the mixed gas to the mixed gas chamber, wherein the inner wall is provided at an inside area of the outer wall, the burner cap comprises a distribution guide protruded from a lower surface of the burner cap to guide a flow of the mixed gas so that the mixed gas introduced into the mixed gas chamber is substantially evenly distributed in the mixed gas chamber, and a distribution protrusion that faces the mixed gas supply pipe and protrudes from the lower surface of the burner cap, wherein the distribution guide has a shape that is rounded in a horizontal direction and comprises a first end and a second end that are spaced apart from each other, wherein the distribution guide is disposed between the distribution protrusion and the outer wall such the distribution guide does not face the mixed gas supply pipe, whereby the mixed gas introduced into the mixed gas chamber flows along the distribution guide in a circumferential direction, and a lower surface of the distribution guide is located lower than a lowest point of the second flame holes relative to a bottom wall of the mixed gas chamber.

13. The burner of claim 12, wherein an outer circumferential surface of the distribution guide is located closer to the inner wall than to the outer wall, such that the mixed gas introduced into the mixed gas chamber flows along the outer circumferential surface of the distribution guide.

14. The burner of claim 12, wherein a difference in height between the height of the lowest point of the second flame holes relative to the bottom wall of the mixed gas chamber and the height of the lower surface of the distribution guide relative to the bottom wall of the mixed gas chamber is at least 2 mm.

15. The burner of claim 12, wherein the distance between the lower surface of the distribution guide and the inner wall of the burner head is at least 1 mm.

16. A burner comprising:

a burner head to receive a mixed gas; and a burner cap to cover the burner head, wherein the burner head comprises an outer wall having a plurality of first flame holes at which a flame is generated, an inner wall having a plurality of second flame holes at which a flame is generated, a mixed gas chamber provided between the outer wall and the inner wall, and a mixed gas supply pipe to supply the mixed gas to the mixed gas chamber, wherein the inner wall is provided at an inside area of the outer wall, wherein the burner cap comprises:

a distribution guide to guide a flow of the mixed gas so that the mixed gas introduced into the mixed gas chamber is substantially evenly distributed in the mixed gas chamber, a distribution protrusion that faces the mixed gas supply pipe and protrudes from a lower surface of the burner cap, and a flow resistance portion to prevent the mixed gas supplied from the mixed gas supply pipe from being concentrated on the plurality of first flame holes provided adjacent to the mixed gas supply pipe, wherein a protruding height of the flow resistance portion from the lower surface of the burner cap is higher than the protruding height of the distribution protrusion from the lower surface of the burner cap, and wherein at least a portion of the distribution protrusion is disposed between the distribution guide and the flow resistance portion.

17. The burner of claim 16, wherein a protruding height of the distribution guide from the lower surface of the burner cap is higher than the protruding height of the distribution protrusion from the lower surface of the burner cap.

18. The burner of claim 16, wherein a protruding height of the flow resistance portion from the lower surface of the burner cap is higher than the protruding height of the distribution guide from the lower surface of the burner cap.

* * * * *